US008894311B2

(12) United States Patent
Gueret

(10) Patent No.: US 8,894,311 B2
(45) Date of Patent: Nov. 25, 2014

(54) EYELINER APPLICATOR

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 976 days.

(21) Appl. No.: 12/992,005

(22) PCT Filed: Jul. 1, 2009

(86) PCT No.: PCT/IB2009/052857

§ 371 (c)(1),
(2), (4) Date: Mar. 3, 2011

(87) PCT Pub. No.: WO2010/001347

PCT Pub. Date: Jan. 7, 2010

(65) Prior Publication Data

US 2011/0170937 A1 Jul. 14, 2011

Related U.S. Application Data

(60) Provisional application No. 61/087,487, filed on Aug. 8, 2008.

(30) Foreign Application Priority Data

Jul. 2, 2008 (FR) ..... 08 54505

(51) Int. Cl.
*A45D 33/00* (2006.01)
*A45D 40/26* (2006.01)

(52) U.S. Cl.
CPC ..... *A45D 40/265* (2013.01); *A46B 2200/1046* (2013.01)
USPC ..... 401/130; 401/118; 401/126

(58) Field of Classification Search
CPC ..... A45D 40/265
USPC ..... 401/118, 126–130; 132/320
See application file for complete search history.

(56) References Cited

U.S. PATENT DOCUMENTS 2,029,835 A * 2/1936 Reichle ..... 401/266
2,397,080 A * 3/1946 Baker ..... 401/130

(Continued)

FOREIGN PATENT DOCUMENTS

DE 30 24 381 A1 1/1982
EP 1 726 236 A1 11/2006

(Continued)

OTHER PUBLICATIONS

International Search Report dated Dec. 3, 2009 for International Application No. PCT/IB2009/052857.

(Continued)

*Primary Examiner* — David Walczak
*Assistant Examiner* — Bradley Oliver
(74) *Attorney, Agent, or Firm* — Oliff PLC

(57) ABSTRACT

An applicator for eyeliner having a stem and an applicator endpiece carried by the stem, the endpiece being of elongate shape along a longitudinal axis and including a flexible zone that deforms while the applicator is in use and that has first and second dimensions $d_x$ and $d_y$ respectively along first and second axes that are perpendicular to each other and perpendicular to the longitudinal axis of the endpiece, the first and second dimensions $d_x$ and $d_y$ being substantially equal; the endpiece including a head extending the flexible zone, the head being connected to the remainder of the endpiece solely via the flexible zone, the head being flat in a plane containing the longitudinal axis and the second axis, and measured parallel to the second axis having a maximum width that is greater than the second dimension $d_y$.

15 Claims, 10 Drawing Sheets

(56) References Cited

U.S. PATENT DOCUMENTS

| | | | | | |
|---|---|---|---|---|---|
| 4,437,477 | A * | 3/1984 | Gueret | 132/320 |
| 4,509,540 | A | 4/1985 | Inagaki | |
| 4,796,647 | A | 1/1989 | Gueret | |
| D300,956 | S * | 5/1989 | Cassai et al. | 401/129 |
| 4,974,980 | A * | 12/1990 | Gueret | 401/119 |
| 5,071,277 | A * | 12/1991 | Braun | 401/126 |
| 5,097,853 | A | 3/1992 | Nehashi | |
| 5,492,426 | A * | 2/1996 | Gueret | 401/126 |
| 5,716,150 | A * | 2/1998 | Gueret | 401/129 |
| 5,888,005 | A | 3/1999 | Gueret | |
| 6,010,266 | A | 1/2000 | Schrepf | |
| 6,070,598 | A | 6/2000 | Gueret | |
| 6,227,737 | B1 * | 5/2001 | Lightfoot | 401/129 |
| 7,077,592 | B2 | 7/2006 | Gueret | |
| 7,112,062 | B2 * | 9/2006 | Lee | 401/126 |
| 7,581,544 | B2 | 9/2009 | Gueret | |
| 8,454,097 | B2 * | 6/2013 | Gueret | 401/129 |
| 2004/0129284 | A1 | 7/2004 | Abergel | |
| 2005/0196219 | A1 * | 9/2005 | Habatjou | 401/127 |
| 2006/0013639 | A1 | 1/2006 | Gueret | |
| 2006/0065282 | A1 * | 3/2006 | Hartstock et al. | 132/320 |
| 2007/0017544 | A1 * | 1/2007 | Gueret | 132/320 |
| 2007/0181143 | A1 * | 8/2007 | Montoli | 132/320 |
| 2012/0312315 | A1 * | 12/2012 | Gueret | 132/200 |
| 2013/0074868 | A1 * | 3/2013 | Shimamura | 132/320 |
| 2013/0276817 | A1 * | 10/2013 | Holloway et al. | 132/320 |

FOREIGN PATENT DOCUMENTS

| | | | |
|---|---|---|---|
| EP | 1 745 717 | A2 | 1/2007 |
| FR | 2 603 780 | A1 | 3/1988 |
| FR | 2 753 057 | A1 | 3/1998 |
| WO | WO 97/21554 | A1 | 6/1997 |
| WO | WO 99/44908 | A1 | 9/1999 |

OTHER PUBLICATIONS

Written Opinion of the International Searching Authority dated Dec. 3, 2009 for International Application No. PCT/IB2009/052857.

* cited by examiner

EYELINER APPLICATOR

The present invention relates to packaging and applicator devices for eyeliner.

Eyeliner applicators are known that include a stem provided at one end with an applicator endpiece constituted by a tip that is tapering, e.g. of generally conical shape. Such applicators do not make it easy to draw a line of greater or lesser width.

U.S. Pat. No. 7,077,592 describes an applicator enabling a line to be drawn with greater or smaller width by means of the presence of two tips. Nevertheless, it is quite difficult to draw a broad line or a narrow line since the tips tend to splay apart from each other under the effect of the pressure exerted against the skin.

Patent application FR 2 890 296 describes another applicator for applying an eyeliner, in which the application endpiece is formed by a flocked endpiece, a felt tip, or a bundle of bristles;

U.S. Pat. No. 4,974,980 describes an eyeliner applicator having a tip that forms a cylindrical body of revolution.

Applicators are also known that include applicator tips in a variety of shapes as described in publications EP 1 745 717 A2, US 2007/0017544 A1, U.S. Pat. No. 6,070,598, and US 2006/0013639.

U.S. Pat. No. 5,888,005 describes a capillary applicator intended more particularly for applying nail varnish. The stem may present a narrow portion of diameter lying in the range 0.5 millimeters (mm) to 1.5 mm. The distal portion of the stem is provide with a slot of width lying in the range 0.2 mm to 2.5 mm, depending on the viscosity of the composition.

U.S. Pat. No. 6,010,266, WO 99/44908, FR 2 753 057, US 2004/0129284, U.S. Pat. No. 5,097,853, and FR 2 603 780 describe other eyeliner applicators.

DE 30 24 381 describes a device for cleaning the skin, in particular passages in the ear or the nose.

U.S. Pat. No. 4,509,540 describes an applicator member mounted on a spring, enabling a cosmetic powder to be dusted on by causing the spring to oscillate.

WO 97/21554 describes a correcting fluid applicator for a paper surface.

There exists a need to benefit from a packaging and applicator device for a cosmetic composition, in particular an eyeliner, that is simple to fabricate and to use, and that enables makeup to be applied carefully, and that is very soft.

In one of its aspects, the invention provides an eyeliner applicator including a stem and an applicator endpiece of elongate shape along a longitudinal axis, the endpiece being carried by the stem. The endpiece has a flexible zone that deforms when the applicator is in use, the flexible zone having first and second dimensions $d_x$ and $d_y$ respectively along first and second axes X and Y that are mutually perpendicular and perpendicular to the longitudinal axis Z of the endpiece. The first and second dimensions are substantially equal. The flexible zone is extended by a head that is flat in a plane containing the longitudinal axis Z and the second axis Y, and that, measured parallel to the second axis Y, has a maximum width $L_{max}$ that is greater than the second dimension $d_y$. The head is connected to the remainder of the endpiece solely via the flexible zone.

By means of the invention, the user can draw a fine line or a broader line depending on the orientation given to the applicator endpiece relative to the skin. The user can also draw a line of greater or smaller width by pressing against the head to a greater or lesser extent, thereby causing it to bend to a greater or lesser extent.

The applicator may be associated with a container containing the composition for application and forming an eyeliner packaging and applicator device.

The flexible zone is the only zone that is flexible and it may be closer to the distal end of the applicator than to the distal end of the stem supporting the endpiece.

In exemplary embodiments of the invention, the head has opposite sides in the directions of the axes X and Y that are the visible outer sides of the endpiece. The term "opposite visible outer sides" should be understood to mean the sides of the endpiece that are furthest apart from each other along the direction of the X axis or the Y axis in question and that do not face some other portion of the endpiece that is even further out along the direction of the axis in question.

The terms "substantially equal dimensions $d_x$ and $d_y$" should be understood as meaning that the dimensions $d_x$ and $d_y$ satisfy $0.5 \leq d_y/d_x \leq 2$, better $0.9 \leq d_y/d_x 1.1$.

The presence of the flexible zone makes application comfortable and makes it easier to obtain a line of desired thickness, by enabling the head to be tilted relative to the skin.

The fact that the flexible zone is of substantially the same dimensions measured parallel to the first and second axes means that it has substantially the same flexibility along those two axes.

The head may have thickness measured parallel to the first axis X that is less than or equal to the first dimension $d_x$ of the flexible zone, in particular thickness e that is substantially equal to said first dimension $d_x$.

The endpiece may be made by molding an elastomer material, and it may optionally include flocking on its surface. The endpiece may present surface irregularities independently of the presence of flocking, for example it may present small spikes or other portions in relief.

The flexible zone and the head of the endpiece may thus be made as a single piece, in particular by molding.

The flexible zone may be situated on the endpiece outside the zone where the head of the endpiece is located. In particular, the flexible zone and the head of the endpiece may follow one another along the endpiece without being superposed one on the other. The head need not necessarily be a hollow endpiece made of foam.

The flexible zone is other than a helical spring or a bellows. The outside surface of the flexible zone may be smooth and continuous over its entire extent.

The greatest transverse dimension of the head may be less than that of the stem.

The flexible zone may present a cross-section that is circular, or polygonal, e.g. having a number of sides that is even and preferably greater than 4, e.g. square, or better hexagonal.

The endpiece may have a portion adjacent to the head that is optionally in the form of a body of revolution about the longitudinal axis of the endpiece. For example, this adjacent portion may present a cross-section that tapers towards the tip, in particular being of conical shape converging towards the flexible zone.

By way of example, the length l of the head, measured along the longitudinal axis of the endpiece, may lie in the range 0.5 mm to 3 mm. For example, the maximum width $L_{max}$ of the head may lie in the range 0.4 mm to 4 mm, better in the range 0.4 mm to 3 mm, better in the range 0.8 mm to 2 mm. The thickness e of the head may lie in the range 0.2 mm to 1 mm, for example.

The flexible zone may have a diameter that is less than or equal to 1 mm, e.g. lying in the range 0.2 mm to 0.8 mm. The diameter of the flexible zone corresponds to the diameter of the smallest circle that can be circumscribed about the flexible zone, and it may be less than or equal to a smallest transverse dimension of the distal end of the stem.

The composition may include at least one pigment that is black or of some other color, being suitable for application to the eyelids.

The applicator endpiece may be filled with composition by capillarity or by being immersed in the composition in the liquid state and then wiping the stem. The container may optionally be provided with a wiper member.

The endpiece may include at least one recess extending longitudinally, e.g. two opposite recesses. The recess(es) may for example be of elongate shape parallel to the longitudinal axis of the endpiece. The recess(es) may for example be of width that decreases towards the distal end of the endpiece.

The endpiece may be symmetrical in shape about a mid-plane, e.g. a plane containing the first and second above-mentioned axes, or about two mutually-perpendicular mid-planes respectively containing the first and second axes. The endpiece may be symmetrical in shape about its longitudinal axis.

The endpiece may optionally be perforated, e.g. having a hole passing through the head and/or a hole passing through the endpiece other than at the head, e.g. between the above-mentioned two opposite recesses. The presence of the hole may control the flow of composition and/or act as a reservoir. The endpiece may be flocked at the head or over its entire visible surface. The head of the endpiece need not be perforated.

The head may have a distal edge that is rounded when observed along the second axis Y. When observed along the first axis X, the distal edge may be rounded, straight, tapering, two-pronged, or notched, amongst other possibilities.

The endpiece may be mounted in various ways on the support, e.g. by being inserted in a housing in the stem, and possibly being stapled in the housing, by die-stamping the stem onto the endpiece, by adhesive, heat-sealing, overmolding, snap-fastening, or by means of an additional part such as a ring that is swaged onto the stem, for example. The endpiece may also be molded integrally with the stem.

The head may have a single vertex at its distal end, which vertex may be situated at the longitudinal end of the endpiece and correspond to the distal end of the applicator, for example.

The stem may be connected to a handle member of orientation that is identified relative to the orientation of the head, in particular a handle member presenting an outside shape that does not form a body of revolution.

In another of its aspects, the invention also provides an eyeliner packaging and applicator device comprising:

a container containing the composition for application; and an applicator including an application endpiece of shape that is elongate along a longitudinal axis, the endpiece including a flexible zone having first and second dimensions $d_x$ and $d_y$ respectively along first and second mutually-perpendicular axes that are perpendicular to the longitudinal axis of the endpiece, $(d_x+d_y)/2$ being less than or equal to 1.2 mm, better 1 mm, better $d_x$ 1.2 mm and $d_y \leq 1.2$ mm, better still $d_x \leq 1$ mm and $d_y \leq 1$ mm, the flexible zone being extended by a head that is flat in a plane containing the longitudinal axis and the second axis Y and that, measured parallel to the second axis Y, has a maximum width $L_{max}$ that is greater than the second dimension $d_y$, the head being connected to the remainder of the endpiece solely via the flexible zone.

In variants of these second exemplary embodiments of the invention, the applicator may present any of the characteristics mentioned above with reference to the first exemplary embodiments of the invention.

In another of its aspects, the invention also provides a method of making up the skin, wherein eyeliner is applied with the help of an applicator as defined above.

The invention can be better understood on reading the following detailed description of non-limiting embodiments thereof, and on examining the accompanying drawings, in which.

Figure 40:
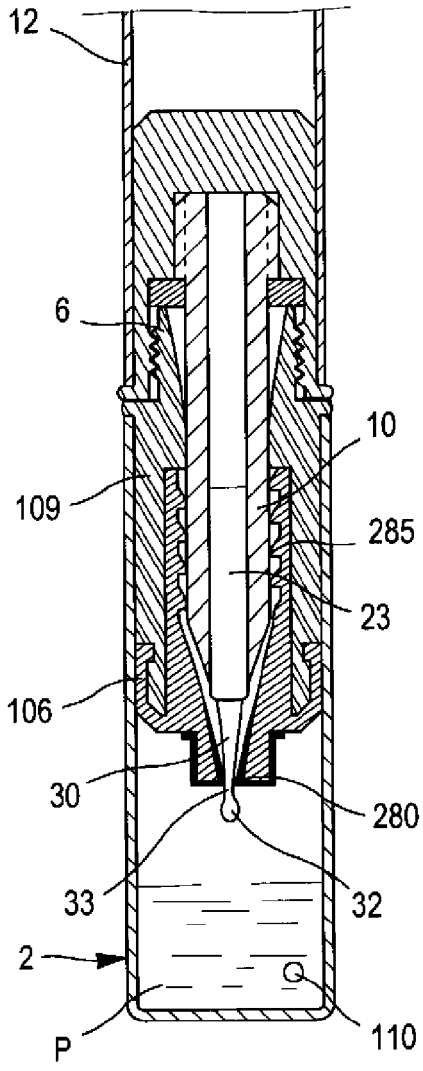
Figure 2:
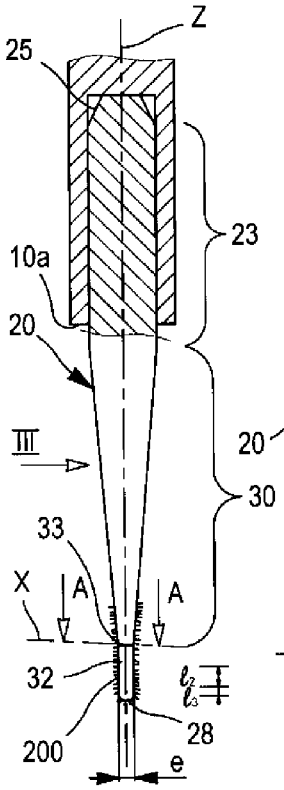
FIG. 2 shows the end of the FIG. 1 applicator device observed from the side looking along the second axis Y.
Figure 3:
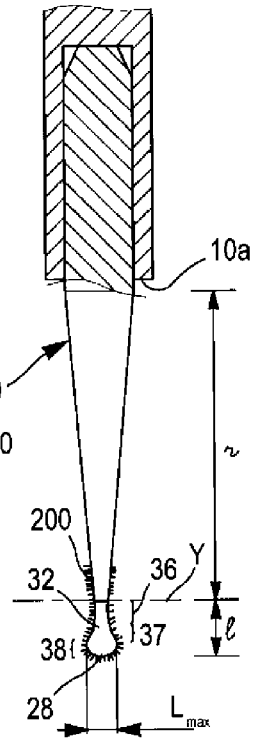
Figure 4:
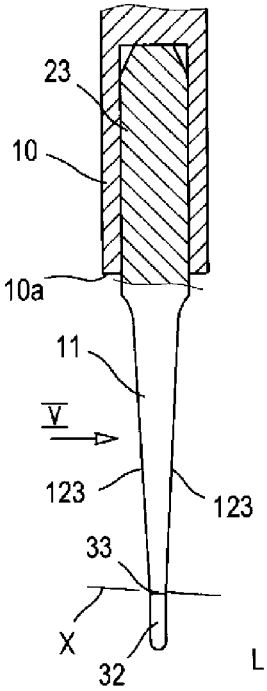
Figure 5:
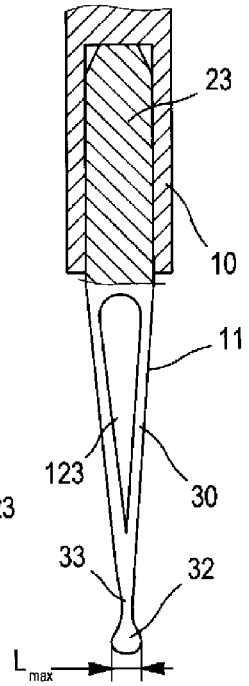
Figure 2A:
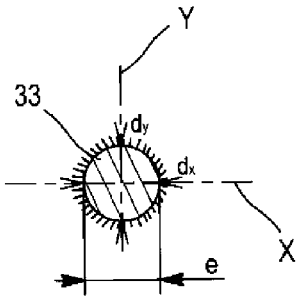
FIG. 2A is a cross-section of FIG. 2 on A-A.
Figure 6:
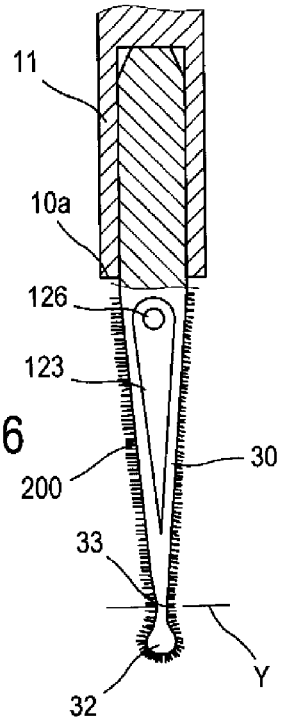
Figure 2B:
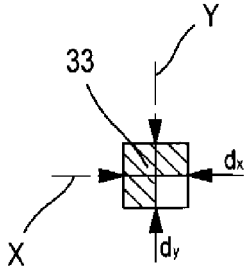
Figure 2C:
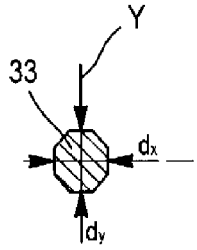
Figure 30:
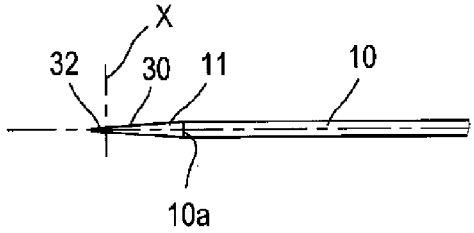
Figure 29:
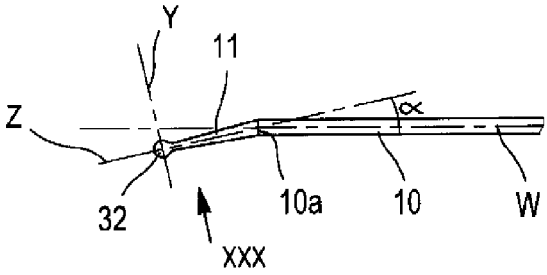
Figure 31:
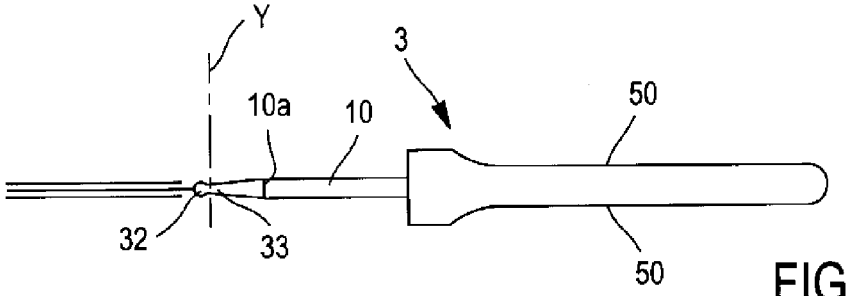
Figure 32:
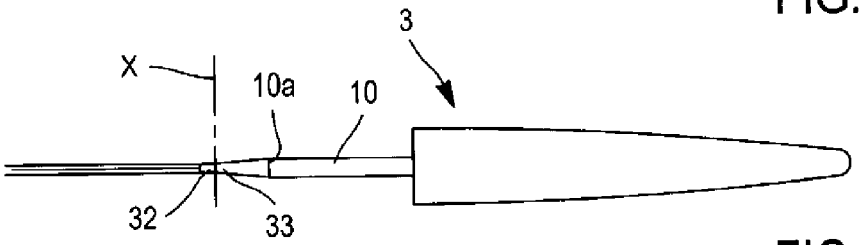
Figure 33:
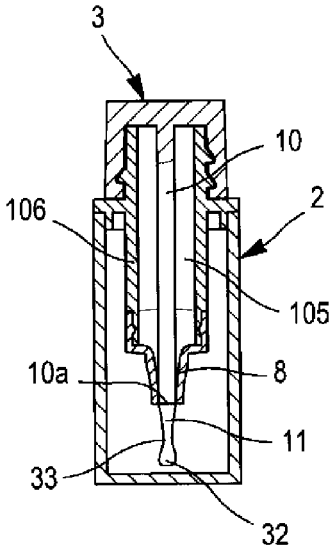
Figure 34:
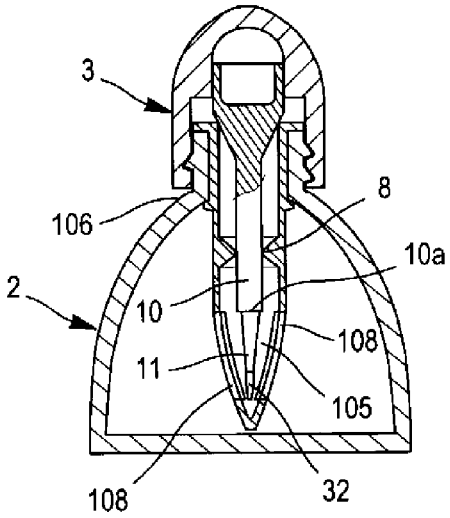
Figure 36:
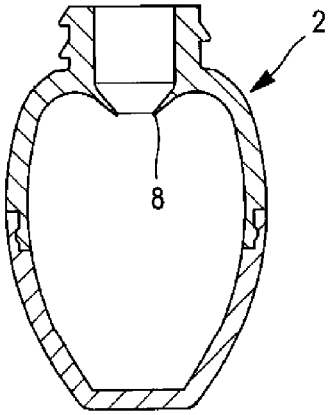
Figure 35:
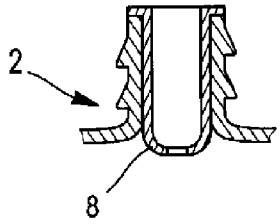
Figure 2D:
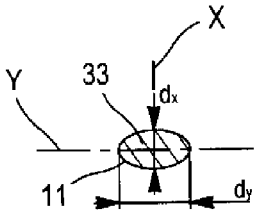
Figure 28:
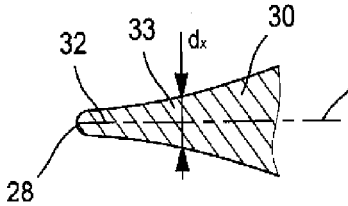
Figure 26:
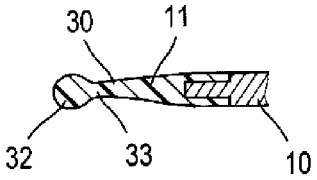
Figure 27:
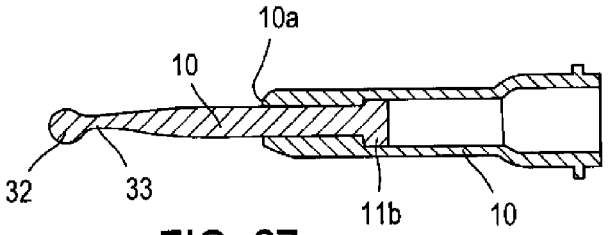
Figure 11:
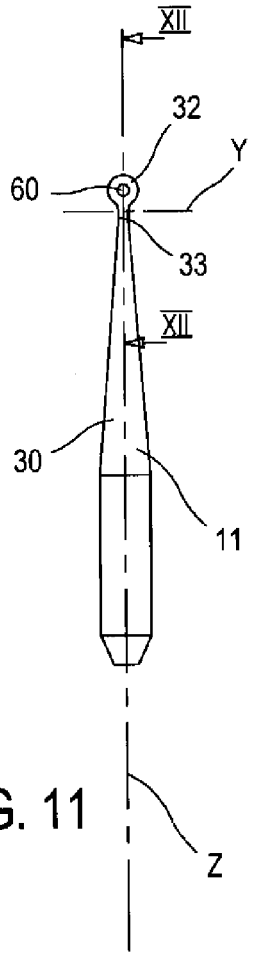
Figure 13:
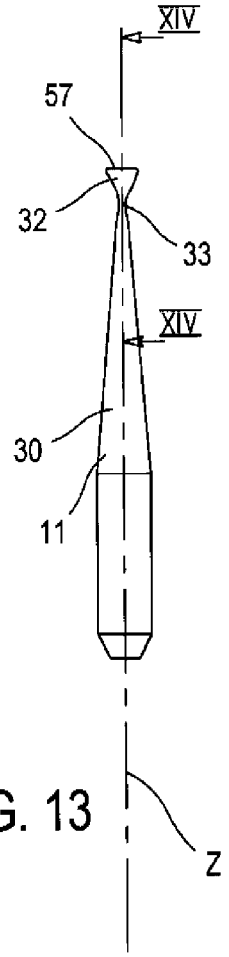
Figure 15:
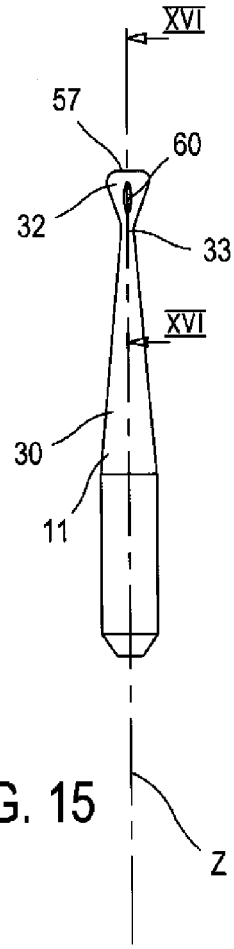
Figure 12:
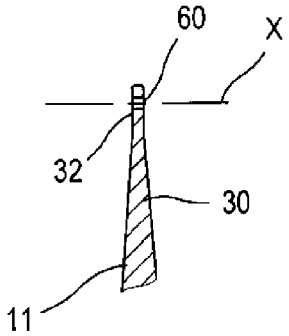
Figure 14:
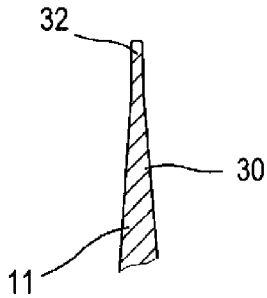
Figure 16:
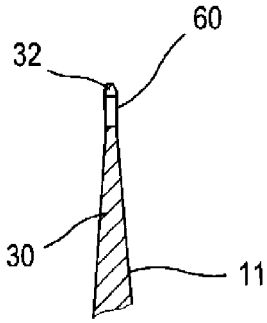
Figure 18:
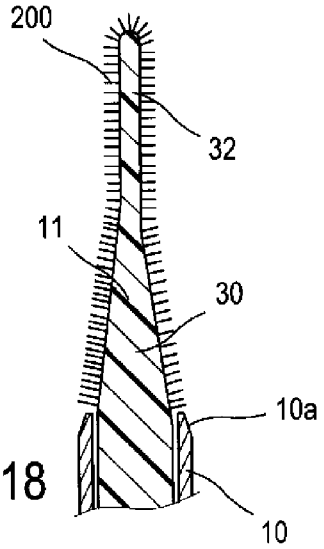
Figure 17:
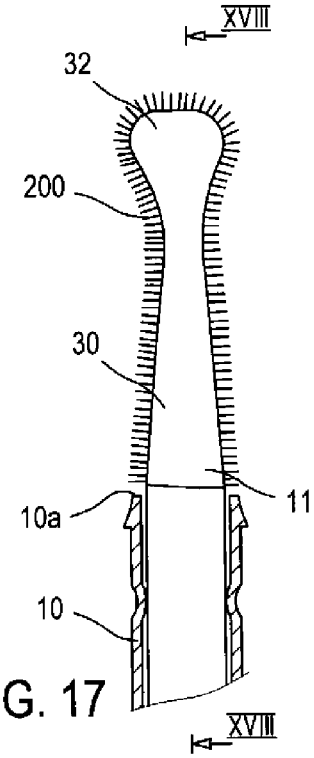
Figure 41:
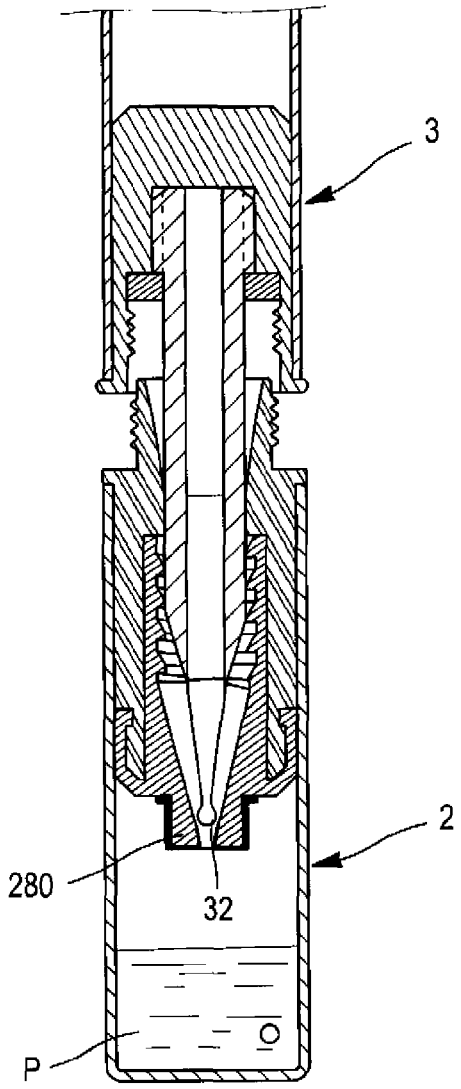
Figure 24:
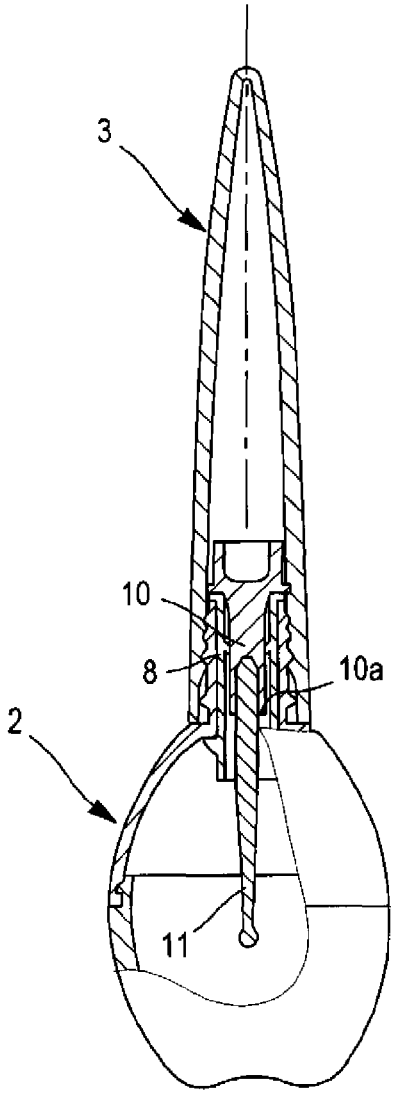
Figure 25:
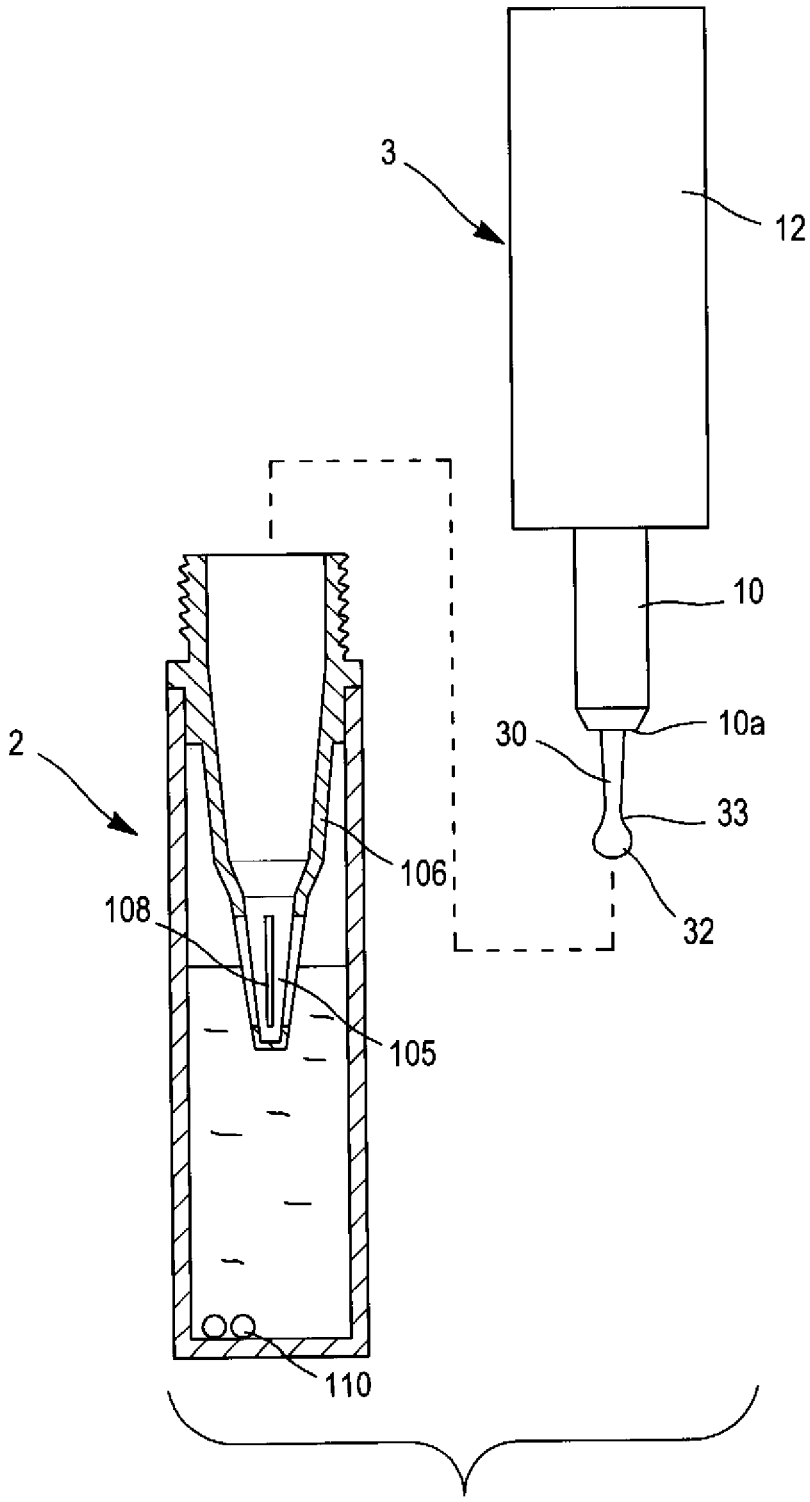
Figure 37:
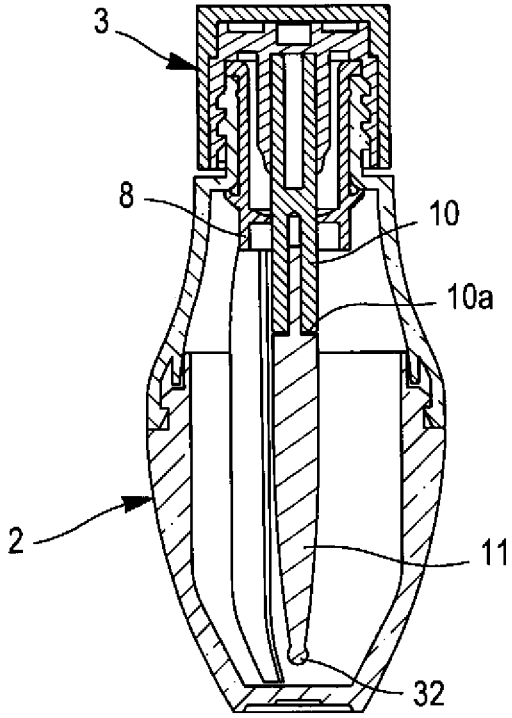
Figure 38:
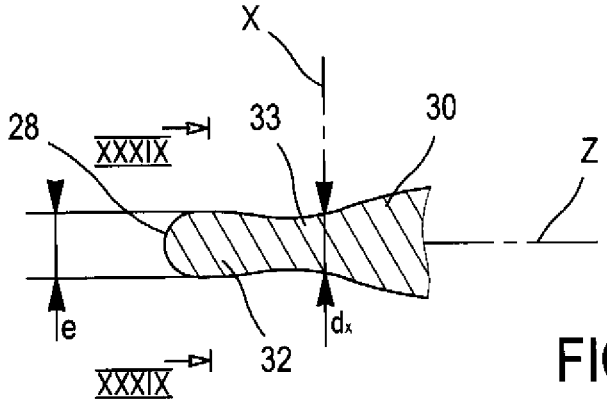
Figure 39:
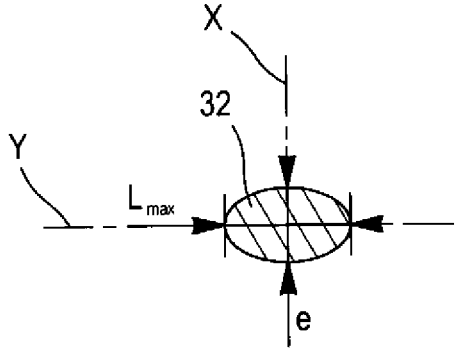

FIGS. 2B, 2C, and 2D show variants of FIG. 2A;

FIG. 3 shows the FIG. 2 applicator seen in face view looking along the first axis X, along arrow III in FIG. 2;

FIG. 4 is a view analogous to FIG. 2 in a variant embodiment;

FIG. 5 is a face view looking along arrow V in FIG. 4;

FIG. 6 is a view analogous to FIG. 5 in a variant embodiment;

FIGS. 7, 8, 8A, 8B, 9, 10, 10A, and 11 are face views looking along the first axis X showing variant embodiments of the applicator endpiece;

FIG. 12 is a longitudinal section on XII-XII of FIG. 11;

FIGS. 13 and 15 are other face views looking along the first axis X showing a variant embodiments of the applicator endpiece;

FIGS. 14 and 16 are longitudinal sections respectively on XIV-XIV and XVI-XVI of FIGS. 13 and 15;

FIG. 17 is a view analogous to FIG. 3 in a variant embodiment;

FIG. 18 is a longitudinal section on XVIII-XVIII of FIG. 17;

FIGS. 19 to 23 are longitudinal section views showing variant embodiments of the applicator endpiece;

FIGS. 24 and 25 are longitudinal section views of variant packaging and applicator devices;

FIGS. 26 and 27 show variant ways of mounting the endpiece on the stem;

FIG. 28 is a longitudinal section view showing a variant embodiment of the endpiece;

FIG. 29 shows a variant applicator, seen in face view along the second axis Y;

FIG. 30 is a view looking along arrow XXX of FIG. 29;

FIGS. 31 and 32 show the applicator in use respectively for drawing a broad line and a narrow line;

FIGS. 33 and 34 are fragmentary and diagrammatic longitudinal section views showing variants of the packaging and applicator device made in accordance with the invention;

FIG. 35 is a fragmentary and diagrammatic section view of the neck of a container fitted with a wiper member;

FIG. 36 is a diagrammatic longitudinal section view of a variant container;

FIG. 37 is a diagrammatic and fragmentary longitudinal section view of a variant packaging and applicator device;

FIG. 38 is a fragmentary and diagrammatic longitudinal section view of a variant application endpiece;

FIG. 39 is a cross-section on XXIX-XXIX of FIG. 39;

FIG. 40 is a diagrammatic longitudinal section of a variant embodiment of a packaging and applicator device according to exemplary embodiments of the invention, the applicator being in place on the container; and FIG. 41 is a view analogous to FIG. 40 shown during removal of the applicator.

Figure 1:
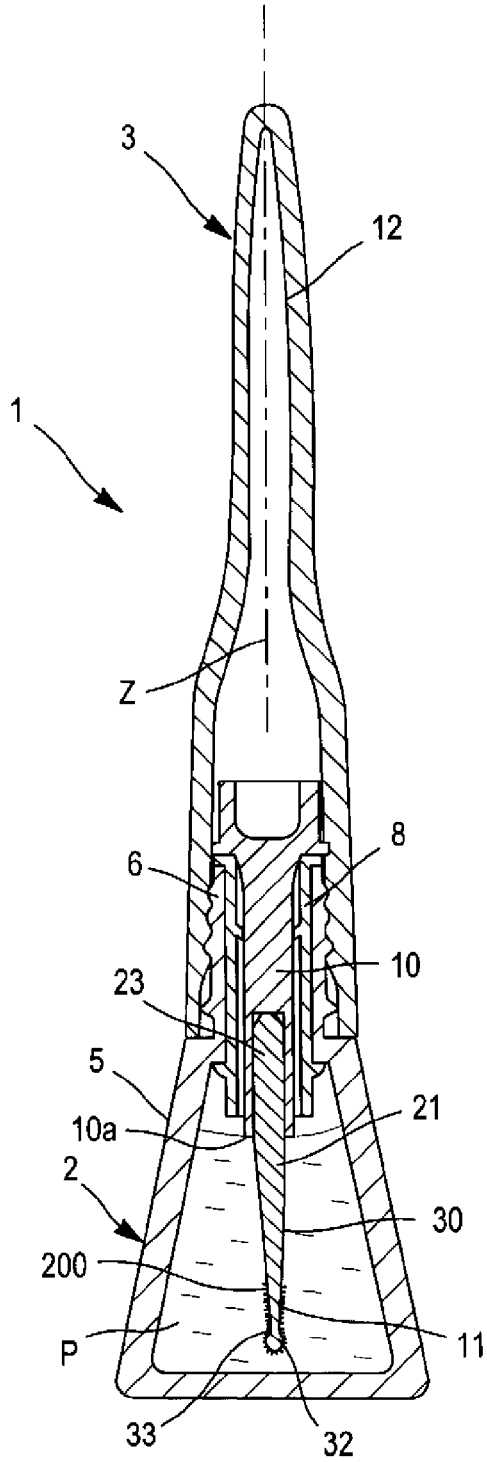
FIG. 1 is a diagrammatic longitudinal section view of an example of a packaging and applicator device made in accordance with the invention.

The packaging and applicator device 1 shown in FIG. 1 comprises a container 2 containing a composition P for application, an eyeliner in the example under consideration, and an applicator 3 capable of being fastened removably on the container 2.

The container 2 comprises a body 5 that may be of arbitrary shape, and that is provided in the example shown with a threaded neck 6 having a wiper member 8 mounted therein.

The applicator 3 may include a stem 10 carrying an applicator endpiece 11 of elongate shape along a longitudinal axis Z, which axis may be rectilinear and may for example coincide with the longitudinal axis of the device, as shown.

The stem 10 is connected at its proximal end to a handle member 12 that is also used as a closure cap for closing the container 2 in leaktight manner when not in use. The handle member 12 is also shown in FIGS. 31 and 32.

FIGS. 2 and 3 shown the distal portion of the applicator in greater detail.

The application endpiece 11 comprises a body 21 having a proximal portion 23 for assembly in the stem 10 of the applicator. The proximal portion 23 may be circularly cylindrical about the axis Z and it may be chamfered at its proximal end 25.

The proximal portion 23 may be received in a housing in the stem 10 and held therein by a staple.

Beside the distal end 28 of the applicator, the proximal portion 23 is extended by a portion 30 of cross-section that tapers towards the distal end 28, this portion being frustoconical in shape, for example, as shown.

The portion 30 is connected to a head 32 of flat shape (the head also being referred to as a spatula-shaped tip) via a flexible zone 33 in which the cross-section of the endpiece 11 in the example under consideration is at a minimum and is circular, as can be seen in FIG. 2A.

The flexible zone 33 is closer to the head 32 than it is to the distal end 10*a* of the stem 10.

The first and second dimensions $d_x$ and $d_y$ of the flexible zone 33 measured along the axes X and Y are equal in the example shown. In the variants of FIGS. 2B to 2D, the flexible zone 33 is of non-circular section, e.g. being of square section as shown in FIG. 2B, octagonal section as shown in FIG. 2C, or elliptical section as shown in FIG. 2D. The diameter of the flexible zone 33 may be less than or equal to 1 mm, preferably lying in the range 0.2 mm to 1 mm, better in the range 0.5 mm to 0.6 mm. By way of example, $d_x \leq 1$ mm, better $d_x \leq 0.7$ mm, and $d_y \leq 1$ mm, better $d_y \leq 0.7$ mm. It is also possible for $d_x = 0.8$ mm and $d_y = 1.2$ mm, but preferably the ratio $d_x/d_y$ is very close to 1, e.g. with $0.9 \leq d_y/d_x \leq 1.1$.

When the endpiece 11 includes flocking 200, the dimensions are measured ignoring the flocking.

The endpiece may present flexibilities along both the X and the Y axes that are substantially equal, in particular when the cross-section of the flexible zone is substantially circular, or presents axial symmetry, in particular polygonal symmetry.

When observed along the second axis Y, in side view as in FIG. 2, the head 32 may present thickness e that is constant from the flexible zone 33 to the vicinity of the distal end 28 which itself may be rounded in shape. By way of example $e = d_x$. The opposite sides of the head 32 along the Y axis define its maximum width $L_{max}$.

When observed along the first axis X perpendicular to the second axis Y, i.e. in face view as shown in FIG. 3, the head 32 presents a width L that is substantially constant over a first portion 36, then increases over a second portion 37 to reach a maximum width $L_{max}$, prior to decreasing over a third portion 38 to define the distal end 28. By way of example $L_{max} \geq 1.1\ d_y$, better $L_{max} \geq 1.5\ d_y$. By way of example $0.8\ \text{mm} \leq L_{max} \leq 2$ mm.

The length $l_2$ measured along the longitudinal axis Z of the second portion 37 may lie for example in the range 0.2 mm to 1 mm, and the length $l_3$ of the third portion 38 may for example lie in the range 0.2 mm to 0.7 mm. The length r of the portion 30 lies for example in the range 2 mm to 13 mm.

The flexible zone 33 may correspond to a constriction formed on the endpiece 11 when the endpiece is observed in a direction perpendicular to the longitudinal axis Z, specifically along the X axis.

The length of the flexible zone 33 measured along the axis Z may lie in the range 0.1 mm to 4 mm, for example. The diameter of the flexible zone preferably lies in the range 0.2 mm to 1 mm, preferably 0.5 mm to 0.6 mm, as mentioned above.

The applicator endpiece 11 of the invention may obtain good flexibility during application and may enable a line to be drawn of constant width that is greater or smaller depending on the orientation of the endpiece 11 relative to the skin. The flexible zone 33 may serve as an all-axis hinge. The applicator 3 may be used to draw a narrow line, as shown in FIG. 32, when it is applied against the skin and moved parallel to the plane containing the axis Z and the second axis Y, and it may be used to draw a broader line when it is moved over the skin after being turned through 90° relative to the position for drawing a narrow line, as shown in FIG. 31. While the applicator is in use, bending of the head 32 and of the flexible portion 33 may be the only deformation of the endpiece that is visible to the naked eye.

Even when the user uses the endpiece 11 to draw a broad line, the endpiece 11 conserves a high degree of flexibility because of the presence of the flexible zone 33 that is capable of deforming visibility during application.

As shown, the handle member 12 may present a shape that is not a body of revolution, in particular it may have a flat shape identified relative to the applicator endpiece so as to make it easy for the user to determine how the applicator endpiece is oriented relative to the skin.

By way of example, the handle member 12 may present a shape that is flat in a plane containing the axes X and Z, e.g. presenting two opposite main faces having portions 50 that extend perpendicularly to the second axis Y.

In a variant, identification can be obtained by means of a mark that appears on the handle member, e.g. a printed mark, a pattern, an indentation, a molded mark, or an etched mark.

Various modifications may be made to the endpiece 11 without going beyond the ambit of the present invention.

The applicator endpiece 11 may include a recess 123, e.g. a flat or hollow recess made in the portion 30 and situated above the head 32 for the purpose of channeling the composition that flows under gravity towards the head, as shown in FIGS. 4 and 5.

The endpiece 11 may include two such recesses 123 that are opposite from each other. The recesses 123 may be open into the faces of the endpiece 11 that face the observer when observing along the axis X perpendicularly to the axis Z.

Where appropriate, the body of the endpiece 11 may be pierced by a hole 126 suitable for uniting the recesses 123, as shown in FIG. 6.

Figure 7:
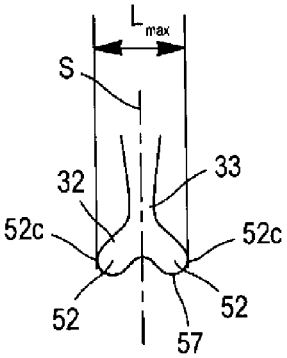

When the endpiece 11 is observed in face view along the first axis X, as shown in FIG. 7, the head 32 may be made with a spatula shape having two branches 52, the distal edge 57 of the endpiece then forming a notched recess 53 between the two branches 52.

The maximum width $L_{max}$ is measured between the outermost edges 52*c* of the branches 52, parallel to the axis Y.

The endpiece may present a shape that is symmetrical about a midplane of symmetry S, containing the axes X and Z.

Figure 8A:
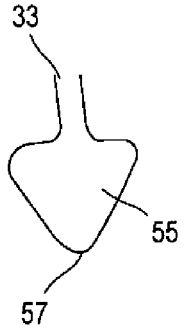
Figure 8B:
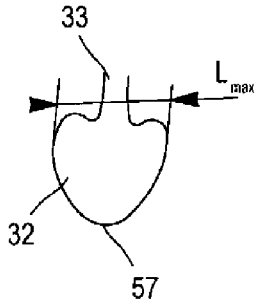
Figure 8:
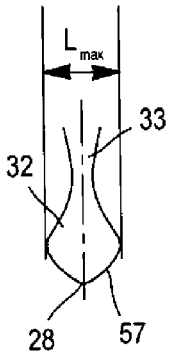

As shown in FIG. 8, when observed along the first axis X, the head 32 may also present a pointed distal edge 57. The point may be heart-shaped as shown in FIG. 8B, or arrow-head-shaped as shown in FIG. 8A.

The vertex may be situated on the axis Z and define the distal end 28 of the applicator.

Figure 9:
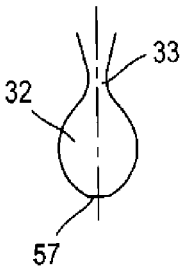

In the example of FIG. 9, as observed along the axis X, the distal edge 57 may be rounded, e.g. circular about an axis parallel to the axis Y.

Figure 10A:
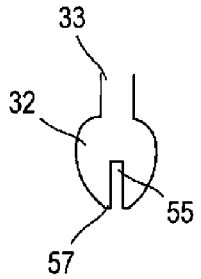
Figure 10:
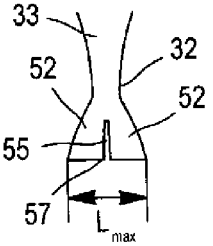

In the example of FIG. 10 or 10A, the head 32 presents two branches 52 that are separated by a notch 55. The notched distal edge 57 may be straight and perpendicular to the longitudinal axis, as shown in FIG. 10, or pointed as shown in FIG. 10A. As shown, and by way of example, the maximum width $L_{max}$ may be situated closer to the distal edge 57 than to the flexible zone 33.

As shown in FIGS. 11 and 12, the head 32 may be perforated, being pierced by a hole 60 of axis that may be parallel to the first axis X. By way of example, this hole 60 is of circular section.

In FIGS. 13 and 15, it can be seen that the head 32 may present an upside-down triangle shape flaring towards the distal end, with a distal edge 57 that is straight and perpendicular to the longitudinal axis Z, for example.

FIGS. 15 and 16 show a perforated head 32 with a rounded distal edge 57, the head 32 being pierced by a hole 60 of shape that is elongate along the longitudinal axis Z.

As shown in FIGS. 17 and 18, the flocking 200 may extend over the body of the endpiece 11, in particular over the portion 30 of cross-section that tapers towards the head. By way of example, the height of the flocking hairs lies in the range 0.3 mm to 1.5 mm.

FIG. 17 shows the possibility of fastening the endpiece 11 to the stem 10 by die-stamping the stem.

Figure 19:
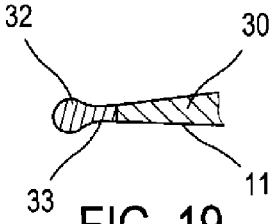
Figure 20:
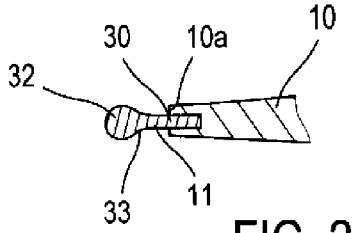

The applicator endpiece 11 may be made of a single material, e.g. an elastomer, or in a variant and as shown in FIGS. 19 and 20, it may be made out of two materials, the head 32 being made for example out of a first material and the body 30 of the applicator endpiece to which the head is connected being made out of a second material. The second material may be harder than the first, or vice versa. By way of example, the endpiece 11 is made by dual-injection of the materials.

As shown in FIG. 20, the applicator endpiece 11 may also include a cylindrical body of revolution 30 having one end inserted into a housing in the stem 10.

The body of the applicator endpiece 11 may be made in various shapes that may depend in particular on the way in which the applicator endpiece 11 is fastened to the stem 10.

Figure 21:
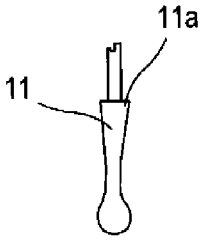
Figure 22:
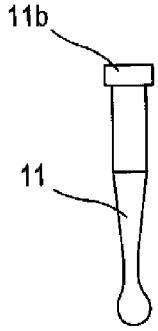
Figure 23:
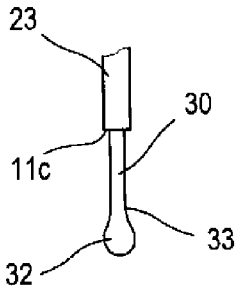

By way of example, the applicator endpiece 11 may present a shoulder 11*a* for coming into abutment against the distal end of the stem 10 in which the endpiece 11 is inserted, as shown in FIG. 21.

At its proximal end, the applicator endpiece 11 may also be made with an enlarged portion 11*b* that comes into abutment in a hollow stem 10.

As shown in FIG. 27, the applicator endpiece may be inserted via the proximal end of the stem 10.

As shown in FIG. 11, the applicator endpiece 11 may also be made with a step 11*c* between the portion 23 for inserting in the stem and the intermediate portion 30 connecting with the head 32.

As shown in FIG. 28, the thickness e of the head 32 may taper going towards the distal end 28 from the flexible zone 33.

As shown in FIGS. 38 and 39, the thickness e of the head 32 may also increase a little after the flexible zone 33 on going towards the distal end 28.

By way of example, $L_{max} \geq 1.5$ e, where e designates the maximum thickness of the head as measured parallel to the axis X.

The container may be made in various ways, and for example it may be made other than by injection blow molding, for example it may comprise two parts that are assembled together as shown in FIG. 24.

Where appropriate, the wiper member may be molded integrally with one of the parts, as shown in FIG. 36.

The applicator endpiece 11 may dip freely into the composition contained in the container, as shown in the examples of FIGS. 1 and 24.

In the variant shown in FIG. 25, the applicator element 11 is received in a housing 105 formed by an insert 106 dipping into the composition inside the container. By way of example, this housing 105 includes one or more perforations 108 enabling the composition contained in the container 2 to impregnate the applicator endpiece 11.

Where appropriate, the container 2 may contain at least one bead 110 enabling its content to be homogeneous by shaking the container prior to use. The bead may be replaced by any other stirrer member.

Where appropriate, the housing 105 may extend down to the bottom of the container, as shown in FIG. 34.

The insert 106 may form the neck of the container, as shown in FIG. 25, or it may be fitted in the neck of the container, as shown in FIG. 34.

Where appropriate, the insert 106 may include at least one wiper lip 8, as shown in FIG. 34.

In the examples of FIGS. 25 and 34, the bottom end of the housing 105 is closed.

In a variant as shown in FIG. 33, the housing 105 has an open bottom end and the endpiece extends beyond the housing 105 towards the bottom of the container. The bottom portion of the insert 106 may form a wiper lip 8.

In the variant of FIG. 40, the endpiece 11 also projects beyond the bottom of the housing 105. The insert 106 may be made of elastomer and press against the conical portion 30 of the endpiece. The insert 106 may include a lip 280 that defines an upwardly-flared inside surface, e.g. having substantially the same slope as the portion 30. The insert 106 may include an inside thread or a succession of corrugations 285 so as to wipe the stem 10. The insert 106 may be fastened to the part 109 that defines the neck of the container.

The container 2 may comprise two portions capable of turning relative to each other in order to stir the composition about the applicator endpiece 11, as shown in FIG. 37. Such containers are described in application US 2005/0232681.

The applicator endpiece 11 may be molded onto the stem 10, as shown in FIG. 26.

In the above examples, the endpiece 11 is preferably molded out of a flexible material, such as e.g. a silicon, polyurethane, nitrile butadiene rubber (EPDM), nitrile butyl rubber, Santoprene®, Hytrel®, an amide block polyether, Pebax®, styrene-isoprene styrene (SIS), styrene-ethylene-butaliene-styrene (SEBS), polyvinyl chloride (PVC), etc. The endpiece 11 may also be made of felt.

All of the above-described applicator embodiments that are shown non-flocked may be flocked, and vice versa. The dimensions $d_x$, $d_y$, e, $L_{max}$ are measured without taking account of the thickness of any flocking. By way of example, the length of the flocking hairs may lie in the range 0.3 mm to 1.5 mm, e.g. being equal to 0.3 mm, 0.5 mm, 1 mm, 1.2 mm, or 1.5 mm.

Where appropriate, the material from which the applicator endpiece is made may be magnetic as a result of having a filler of magnetic particles within the plastics material.

As shown in FIGS. 29 and 30, the longitudinal axis Z of the endpiece 11 may make an angle a relative to the longitudinal axis W of the stem 10 to make it more ergonomic. The axes W and Z may lie in the same plane as that defined by the axes Y and Z, or in a variant as that defined by the axes X and Z.

Where appropriate, the applicator may be subjected to vibration during application.

The term "comprising a" should be understood as being synonymous with "comprising at least one".

The invention claimed is:

1. An applicator for eyeliner, the applicator comprising a stem and an applicator endpiece carried by the stem:

i) the endpiece being of elongate shape along a longitudinal axis;

ii) the endpiece including a flexible zone that deforms while the applicator is in use and that has first and second dimensions $d_x$ and $d_y$ respectively along first and second axes that are perpendicular to each other and perpendicular to the longitudinal axis of the endpiece, the first and second dimensions $d_x$ and $d_y$ being substantially equal, the flexible zone being closer to a distal end of the applicator than to a distal end of the stem; and iii) the endpiece including a head extending from the flexible zone, the head being connected to a remainder of the endpiece solely via the flexible zone, the head being flat in a plane containing the longitudinal axis and the second axis, and measured parallel to the second axis, the head having a maximum width ($L_{max}$) that is greater than the second dimension $d_y$, the maximum width ($_{Lmax}$) of the head being within a range of 0.4 mm to 4 mm.

2. The applicator according to claim 1, the head having a thickness (e) measured parallel to the first axis that is less than or equal to the first dimension ($d_x$) of the flexible zone.

3. The applicator according to claim 1, the first and second dimensions $d_x$ and $d_y$ satisfying $0.9<d_y/d_x<1.1$.

4. The applicator according to claim 1, the flexible zone being of circular cross-section.

5. The applicator according to claim 1, the endpiece having a portion adjacent to the head, the portion forming a body of revolution about the longitudinal axis of the endpiece.

6. The applicator according to claim 5, the portion of the endpiece adjacent to the head having a cross-section that tapers towards the head.

7. The applicator according to claim 1, a length (l) of the head being within a range 0.5 mm to 3 mm.

8. The applicator according to claim 2, the thickness (e) of the head being within a range of 0.2 mm to 1 mm.

9. The applicator according to claim 1, the flexible zone having a diameter less than or equal to 1 mm.

10. The applicator according to claim 1, the head being flocked.

11. The applicator according to claim 1, the stem being connected to a handle member of orientation that is identified relative to the orientation of the head.

12. The applicator according to claim 11, the handle member having an outside shape that does not form a body of revolution.

13. The applicator according to claim 1, the endpiece including at least one longitudinally-extending recess.

14. The applicator according to claim 1, the endpiece being perforated.

15. The applicator according to claim 14, the head being notched or pierced by a hole.

* * * * *